US012576340B2

(12) United States Patent
Harteloh

(10) Patent No.: US 12,576,340 B2
(45) Date of Patent: Mar. 17, 2026

(54) AMUSEMENT SYSTEM FOR SHOWING AN EVENT IN A SCENE ROOM

(71) Applicant: VEKOMA RIDES ENGINEERING B.V., Vlodrop (NL)

(72) Inventor: Bart Harteloh, Vlodrop (NL)

(73) Assignee: VEKOMA RIDES ENGINEERING B.V., Vlodrop (NL)

( * ) Notice: Subject to any disclaimer, the term of this patent is extended or adjusted under 35 U.S.C. 154(b) by 399 days.

(21) Appl. No.: 18/278,300

(22) PCT Filed: Feb. 22, 2022

(86) PCT No.: PCT/EP2022/054378
§ 371 (c)(1),
(2) Date: Aug. 22, 2023

(87) PCT Pub. No.: WO2022/180024
PCT Pub. Date: Sep. 1, 2022

(65) Prior Publication Data

US 2024/0123361 A1 Apr. 18, 2024

(30) Foreign Application Priority Data

Feb. 23, 2021 (NL) ..... 2027619

(51) Int. Cl.
*A63G 1/10* (2006.01)
*A63G 1/30* (2006.01)

(52) U.S. Cl.
CPC ..... *A63G 1/10* (2013.01); *A63G 1/30* (2013.01)

(58) Field of Classification Search
CPC ..... A63G 1/10
(Continued)

(56) References Cited

U.S. PATENT DOCUMENTS 1,406,705 A * 2/1922 Welch ..... A63G 1/30 472/33
10,279,274 B1 * 5/2019 Brister ..... A63G 1/48
(Continued)

FOREIGN PATENT DOCUMENTS

AU 199731903 B2 1/1998
CN 104436664 A 3/2015
(Continued)

OTHER PUBLICATIONS

International Search Report, issued in PCT/EP2022/054378, PCT/ISA/210, dated Jun. 9, 2022.
(Continued)

*Primary Examiner* — Travis R Hunnings
(74) *Attorney, Agent, or Firm* — Birch, Stewart, Kolasch & Birch, LLP

(57) ABSTRACT

An amusement system for entertaining a group of passengers by showing at least one event in at least one delimited space includes at least one pair of a neighbouring first and second structures. Each structure has a centre of rotation defining a vertical axis A-A, and at least one carriage for carrying at least one passenger. Each structure includes at least three wall portions which are laterally extending, wherein a segment TS is defined in between each neighbouring wall portion. The first and second structures are arranged as a cooperating pair of structures in that in operation the first and second structures are driven in rotation by a control unit in opposite directions with respect to each other.

20 Claims, 5 Drawing Sheets

(58) Field of Classification Search
USPC ..... 472/1
See application file for complete search history.

(56) References Cited

U.S. PATENT DOCUMENTS

| | | | | |
|---|---|---|---|---|
| 10,369,483 | B1 * | 8/2019 | Hall | A63G 33/00 |
| 12,083,680 | B2 * | 9/2024 | Burger | B25J 11/0015 |
| 12,387,543 | B2 * | 8/2025 | Aman | H04Q 9/00 |
| 2018/0311588 | A1 * | 11/2018 | Beumers | A63G 31/16 |
| 2020/0398173 | A1 * | 12/2020 | Larberg MacLean | A63G 1/00 |
| 2021/0008460 | A1 * | 1/2021 | Hall | A63G 1/24 |

FOREIGN PATENT DOCUMENTS

| | | | |
|---|---|---|---|
| CN | 204767337 | U | 11/2015 |
| EP | 1833585 | B1 | 10/2014 |
| GB | 2249729 | A | 5/1992 |
| WO | WO 98/00212 | A1 | 1/1998 |
| WO | WO 2011/068566 | A1 | 6/2011 |
| WO | WO 2015/074086 | A2 | 5/2015 |
| WO | WO 2019/147416 | A1 | 8/2019 |
| WO | WO 2019/147746 | A1 | 8/2019 |
| WO | WO 2020/167818 | A1 | 8/2020 |

OTHER PUBLICATIONS

Search Report issued in NL 2027619, dated Feb. 23, 2021.
Written Opinion of the International Searching Authority, issued in PCT/EP2022/054378, PCT/ISA/237, dated Jun. 9, 2022.

* cited by examiner

AMUSEMENT SYSTEM FOR SHOWING AN EVENT IN A SCENE ROOM

The present invention relates to an amusement system and method for entertaining a group of passengers in a carriage by showing an event in a delimited space. In particular, the invention relates to a tower ride system which is further arranged to provide a tower ride, in which in particular the delimited space is formed by a scene room of a scene room building.

US2018/311588A1 discloses a rotatable polygonal platform which is divided into multiple segments. Around the platform one or more scenes are created and positioned circumferential around the rotating platform. The scenes consist of interactive objects, such as large screens. The interactive objects are arranged to interact with a group members within a segment.

GB2249729A0 which is published in 1990 discloses a same game apparatus comprising a plurality of playing areas, each containing an apparatus for playing a game, and at least one carrier adapted to carry a plurality of teams of at least one player each. Preferably, the carrier comprises a central platform adapted to be rotatable. Means are provided for causing relative movement between the playing areas and each carrier such that, at predetermined intervals, each team is presented with the apparatus for playing a game in a different playing area.

WO98/00212 is a disclosure in the name of Sega Sammy Holdings Inc which is published in January 1998. A falling amusement ride is disclosed which is capable of letting a player enjoy a thrill of dropping to the same extent as in a conventional equipment in spite of its height restrained low is provided. The falling amusement ride has a seat supported so as to go up and down to be dropped, and an illusion giving device for giving an illusion regarding a sense of height to the player sitting on the seat.

EP1833585B1 is a European patent in the name of Vekoma which is published in September 2007. An amusement park attraction is disclosed which comprises an array of cells. The array including cells is arranged at various horizontal positions and various vertical positions. A cell is defined by a boundary and has a viewing opening. Multiple cells of said array each contain a discrete scene to be viewed by a passenger. A passenger assembly is provided which is movable in a vertical and horizontal direction by a programmable actuating system. The actuating system provides a programmed route of the passenger assembly along the viewing openings of said scene containing cells, so that the passengers are presented a predetermined sequence of scenes and experience at least a vertical motion along said route.

WO11068566 is a disclosure in the name of Universal City Studios which is published in June 2011. An attraction device is disclosed which is engagable with a plurality of spaced guest supports that are movable along a path proximate a carousel. The carousel having a plurality of domes is configured to temporarily and separately synchronize with the guest supports. Each dome has a viewing portion that is positioned toward the guest supports and is movable to temporarily cover to guest supports. An image projecting assembly is supported by each dome and configured to display an image on the viewing portion.

CN104436664 is a disclosure in the name of Shenzhen Oct Vision Inc which is published in March 2015. A free-fall ride with a movie watching system is disclosed. The free-fall ride comprises at least two movie watching lift cars, a column, a drive device and a counterweight device. A screen platform upon the ground by a preset height is arranged on one of two sides of the free-fall ride. Circular screens are arranged upon the screen platforms and parallel to the column. As the movie is played, the moving watching cars ascend or descend, making an immersive and three-dimensional atmosphere to the players.

WO2015074086 is a disclosure in the name of Raven Sun Creative which is published in November 2015 shows a similar movie watching system which is here adapted to a four-fold version.

WO2019147416 in the name of Universal City Studios LLC is published in August 2019. An interactive tower attraction is disclosed which comprises ride vehicles to carry passengers during operation of the ride. A tower is provided which supports the ride vehicles and provides a generally vertical vehicle path along which each vehicle can move up or down. Each vehicle is coupled to a corresponding tower track. An embodiment is disclosed in which a central space inside a tower is formed by interior walls. The interactive tower attraction is beneficial in having a high passenger capacity. The interactive tower attraction includes two ride vehicles disposed on opposite sides of each wall of the tower, such that one ride vehicle is disposed inside of the tower while the other ride vehicle is disposed outside of the tower at a particular time. A lower portion of the interior wall may be rotatable 180° or 360° about a central vertical axis of the wall to enable a ride vehicle to be rotated from inside the tower to outside the tower, and back again. While riders inside of the tower are riding the interactive tower attraction, new riders may be loading the ride vehicles currently outside of the tower. This simultaneously riding and loading contributes to increase a passenger capacity of the attraction. A high hourly passenger rate can be achieved. However, a drawback of the attraction is that it offers limited opportunities for variable ride experiences.

WO2019147746 in the name of Universal City Studios LLC is also published in August 2019. A ride system for an amusement park including a plurality of scene rooms stacked atop one another and a ride vehicle is disclosed. The ride vehicle is transported from a first room to a second room by withdrawing the ride vehicle from the first room, changing a vertical height of the ride vehicle, rotating the ride vehicle, and inserting the ride vehicle into the second room. The presence of multiple scene rooms is beneficial in contributing in increasing a variety of ride experiences is beneficial. However, this ride system has a drawback in that the intermittent traveling of the ride vehicle along the stacked scene rooms reduces a dynamic character of a tower ride.

WO2020167818 in the name of Universal City Studios LLC is published in August 2020 and discloses an amusement park system with a tower building having a central passage. The tower building is configured to rotate about a central axis to provide a scene-driven narrative or other experience to passengers. The tower building includes multiple compartments having various scenes oriented and exposed toward the central axis from an interior circumference of the tower building. A scene may be defined as a representation of a segment of a narrative of a ride system. A ride vehicle is disposed within the central passage. A drive system is coupled to the ride vehicle to displace the ride vehicle vertically within the central passage of the tower building. The ride system exposes passengers of the ride vehicles to a series of scenes as the ride vehicle moves vertically and as the tower building rotates around the ride vehicle. In this manner, as the tower building rotates and the ride vehicles are driven vertically within the central passage, the passengers within the ride vehicles may experience a narrative through exposure to a sequence of various scenes displayed via the compartments. As said above, the presence of multiple scene rooms is beneficial in contributing in increasing a variety of ride experiences. However, this ride system also has a drawback in that the intermittent traveling of the ride vehicle along the stacked scene rooms reduces a dynamic character of a tower ride. Further, the matrix arrangement of compartments in the tower building is limiting possibilities for a story line provided by the attraction.

Regarding the above mentioned prior art, it is remarked that any discussion of documents, acts, materials, devices, articles or the like included in the present specification is for the purpose of providing a context for the present invention, and is not to be taken as an admission that any such matters form part of the prior art or were before the priority date of each claim of this application common general knowledge in the field relevant to the present invention.

The general object of the present invention is to at least partially eliminate the above mentioned drawbacks and/or to provide a usable alternative. More specific, it is an object of the invention to provide an amusement system for entertaining a group of passengers by showing at least one event in at least one delimited space. In particular, the amusement system provides a dynamic experience to the passengers in which the passengers are entertained by spectacularly changing sceneries.

According to a first aspect of the invention, this object is achieved by an amusement system according to claim 1.

According to the first aspect of the invention, an amusement system is provided for entertaining a group of passengers by showing at least one event in at least one delimited space. In particular, the amusement system is a high capacity attraction system in which multiple carriages are incorporated to allow a large group of passengers to simultaneously experience an event in the delimited space. In particular, the amusement system allows groups of passengers to simultaneously enjoy events presented in different delimited spaces.

The amusement system comprises at least one pair of a neighbouring first and second structure. Each structure has a centre of rotation. The centre of rotation is positioned in a central region of the structure. Each structure comprises a vertical axis which is in particular defined by a vertical column. At least a portion of the first and second structure is rotatable about the vertical axis to an angular position to rotate in alignment with the delimited space. The amusement system is further provided with at least one carriage for carrying at least one passenger.

Each structure comprises at least three wall portions. The wall portions are laterally extending from the vertical axis, in particular from the vertical column. A segment is defined between each neighbouring wall portions. When the at least one event is shown, the carriage is situated in the segment. In the angular position of the structure, neighbouring wall portions of the structure delimit a space by providing a visual boundary. A passenger view from the carriage is limited by the wall portions. To entertain the passenger, in the delimited space, an event, e.g. a sky line scenery or an image projection, is presented. Entertaining should be considered in a broad sense as including educating and informing.

In other words, each structure is an n-fold structure, wherein the parameter 'n' is larger than three. Each structure has a rotational symmetry in cross section. The structure is preferably a three-fold structure having a three-fold rotational symmetry. The three-fold structure is arranged to rotate between a first, second and third angular position. Each structure comprises an n-amount of wall portions which may be mounted to a vertical column, in which the wall portions are laterally extending from the vertical column. Each pair of neighbouring wall portions defines a segment in between them. The n-fold structure is arranged to rotate to an n-amount of angular positions. In each angular position, a segment is aligned with the delimited space. The delimited space may be arranged to show an event, e.g. on a screen or may be arranged as an entry station.

The amusement system provides an improvement in that the first and second structure are arranged as a cooperating pair. The pair of structures are cooperating in that in operation the first and second structures are driven in rotation in opposite direction with respect to each other. The amusement system comprises a control unit. The control unit is programmed to control the rotation of the first and second structures. The control unit is programmed to rotate the first structure in an opposite direction with respect to the rotational direction of the second structure. In operation, the first structure may rotate clockwise, and the second structure may rotate counter-clockwise or vice versa.

The amusement system according to the invention may provide several benefits.

A major benefit is that the amusement system can be arranged to deal with a large volume of passengers per hour. The amusement system may have a high passenger capacity. A high through flow of passengers per hour can be obtained. Passengers can be boarding at an entry station at a first segment of the structure, while simultaneously other passengers in one of the other segments can enjoy the attraction by experiencing an event in the delimited space.

A great benefit of the amusement system is provided by the cooperation of the first and second structure. In operation, the structures rotate in opposite directions about their centres or rotation. The pair of structures may rotate synchronously. Seen at a front side of the amusement system, e.g. at the entry station, the structures rotate away from each other and at a rear side, the structures rotate towards each other.

These opposite rotations make that passengers of the first structure can meet passengers of the neighbouring second structure in a common delimited space, in particular in a common scene room of a scene room building. The common delimited space is formed by an alignment of respective wall portions of the first and second structure in a predetermined angular position. In the alignment, the respective wall portions may directly engage with each other or indirectly via an intermediate wall positioned in between the pair of the neighbouring first and second structure. The common scene room forms a large scene room which may provide extra excitement to the passengers. A rotation from a visit of a small scene room into the large common scene room can bring a surprising moment to the passengers. The opposite rotations of the neighbouring structures further allow carriages of the amusement system to travel through multiple scene rooms provided by the several rotating structures of the amusement system. The carriage can travel from a first scene room provided only by a first structure to a common scene room provided by the first and second neighbouring structures and subsequently to a next scene room provided only by the second structure. Herewith, the carriage can travel from a first scene room provided by a first pair of structures to another scene room provided by a second pair of structures. The carriage travels laterally along the rotating wall portions which may appear to passengers as doors which open for a next scenery. An exemplary embodiment is described in detail hereafter and illustrated by FIGS. 8-11.

In addition to the at least one pair of a neighbouring first and second structure, the amusement system may comprise an auxiliary structure. The auxiliary structure may include neighbouring wall portions similar to the first and second structure. Such an auxiliary structure may be a fixed structure, e.g. positioned at a centre region of the amusement system or at circumference of the amusement system. Such an auxiliary structure may be arranged as a rotating structure. In an embodiment of the amusement system according to the invention, the amusement system may comprise a first, second and third structure, wherein the first and second structure from the neighbouring pair of structures which in operation rotate in opposite directions with respect to each other.

In an embodiment according to the invention, the amusement system is an observation system in which the passengers are entertained by providing a view on the delimited space. Preferably, the carriage of the observation system is vertically movable, such that a passenger can travel from beneath to reach a top of the structure. By a rotation of the structure to the predetermined angular position, a passenger view is directed and the neighbouring wall portions aside the carriage shield the passenger view. The passenger view is directed and delimited by the wall portions to observe a predetermined section of an area forming the delimited space. The wall portions are aligned with an imaginary boundary which delimits the predefined section of the area which is interesting to observe. Such an area may for example be a historic city part, or a particular terrain of a zoo area. The event shown to the passengers is in these examples formed by respectively a historic building or particular animals at the delimited space which is visual from the carriage. Herewith, the observation system is beneficial in dealing with large groups of people to present them a predetermined and delimited view over a predetermined section of an area.

In an embodiment according to the invention, a rotatable structure comprises a vertical column. The vertical column forms the centre of rotation and defines the vertical axis. The structure is formed by the vertical column at the central region of the structure, wherein the at least three wall portions are connected to the vertical column. Preferably, the vertical column is formed by a tubular profile. Exemplary embodiments of such a structure are shown in FIGS. 1-7.

In an alternative embodiment according to the invention, a rotatable structure is formed by interconnected wall portions. The rotatable structure may further comprise a base platform, wherein the at least three wall portions are connected with the base platform. Herewith, instead of a vertical column at the centre of rotation, e.g. a vertical column formed by a framework of linked bars or said tubular column, the structure may have an hollow inner space at the central region. Such a structure is for example shown in FIG. 8-11.

In an embodiment according to the invention, the structure is rotatable by a rotatable vertical column. The vertical column may be rotatable about its whole length. Alternatively, only a column portion may be rotatable, wherein a remaining column portion is arranged stationary. The remaining column portion is a fixed column portion. Preferably, the rotatable column portion is a lower column portion. The lower column portion of the vertical column is rotatable with respect to an upper column portion which is arranged stationary. The rotatable column portion has laterally extending wall portions which rotate together and align in the angular position with stationary wall portions of the remaining column portion. In an embodiment the amusement system may include a vertical motion system in which the carriage is vertically movable along the fixed column portion.

In an embodiment of the amusement system according to the invention, the first and second structure, or as said at least a portion thereof, are rotatable in a stepwise manner. In a step of rotation, each structure rotates to an angular position in which the structure is in alignment with the delimited space. In the angular position, the structure pauses to allow a passenger in a first segment to enjoy a shown event, while another passenger in another segment of the structure may enter or exit a carriage.

In an alternative embodiment, the first and second structure are rotatable in a continuous manner. Sceneries may smoothly change when wall portions approach each other and subsequently move away from each other. A carriage may travel from a first scene room to a second and next scene room formed by successively a first, second, third structure etc. An exemplary embodiment of such a continuously rotating amusement system is hereafter described in further detail and shown in FIGS. 8-11.

In an embodiment according to the invention, the amusement system is a vertical motion system. The vertical motion system is arranged for entertaining a group of passengers by providing a vertical motion. In the amusement system, the passengers experience a vertical motion and are entertained by an event shown in the delimited space.

In an embodiment according to the invention, the amusement system comprises a tower ride system for entertaining a group of passengers by providing a tower ride and by showing an event in the delimited space. In the tower ride system, the at least one pair of the neighbouring first and second structure is a pair of a first and second tower ride structure. Each segment of the structure is a tower ride segment. The vertical column is provided with at least one track for providing a ride. At least one tower track is positioned in each tower ride segment. At least one ride vehicle is positioned and vertically movable connected to the tower track in tower ride segment. Each ride vehicle includes a carriage for carrying passengers. The tower ride system is beneficial as an attraction, because it allows the amusement system to be adapted to many situations. For example, in an observation system including the tower ride system, elevating the passengers to a height is advantageous to increase an excitement of a passengers view. The tower ride system is further beneficial in having a relative small footprint.

In an embodiment according to the invention, the amusement system further comprises a scene room building. The scene room building houses at least one scene room for showing an event to the passengers. In particular, the scene room forms a compartment with a viewing opening. In particular, the viewing opening is directed to a centre region of the scene room building. A carriage can be positioned in front of the viewing opening to allow the passengers to look at an event inside the compartment.

An advantage is that the scene room building which is adapted to the pair of neighbouring rotatable structures may have a variety of both small and large scene rooms. This variety of scene rooms enhances further possibilities in narrating a particular story. Passengers can be transferred along a series of scene rooms by a rotation of the structure and/or a vertical movement of a carriage, wherein a series of events is shown to the passengers. The variety of scene rooms allows an attraction to include a particular storyline combined with a series of events to be provided in an enjoyable manner to the passengers wherein the size of the scene rooms is adapted to the particulars of the events. An introductional part of a story of an attraction can for example be told in a small scene room, wherein an end stage of an attraction can be experienced in a large scene room within the scene room building. Advantageously, this large scene room can be visited at the same time by passengers of both the first and second structure.

In exploiting an amusement parks, it is an advantage that the large scene room can be provided by combining segments of neighbouring structures. The large scene room is enjoyed at the same time by passengers of both tower ride structures. The commonly used large scene room may provide an operational advantage in managing the attraction. The same event is shown to more passengers at the same time. In addition, as the structures are rotatable, it is an operational advantage that the scene room building can be arranged stationary. No drive systems and accompanying control systems are necessary to displace scene rooms. The simple architecture of the amusement system contributes to operational benefits and at the same time offers more flexibility to vary the attraction.

In an embodiment of the amusement system, in particular the tower ride system, according to the invention, the scene room building may comprise a stack of scene rooms. Multiple scene rooms are arranged in a vertical direction and delimited from each other by a scene room floor. The stacked scene rooms can be visited by the passengers when moving in the vertical direction by a tower ride.

In an embodiment according to the invention, the scene room building is formed by a shopping mall. The shopping mall may contain several mall sections which may serve as a scene room. For example, the shopping mall may contain multiple stores connected by a balustrade, which balustrade may function as a first scene room. The pair of structures can be positioned in front of the balustrade scene room. The passengers may play a game by using input devices. The balustrade can also be used by a member of the public for playing an interactive game with passengers in a carriage. Members of the public in the shopping mall who are present on the balustrade may take part in the interactive game. Herewith, an existing shopping mall can be turned into an exciting area for experiencing an attraction.

In an embodiment of the amusement system, the scene room building comprises a scene room wall. The scene room wall encloses at least one segment, such that the delimited space forms a scene room. The scene room wall is configured to at least partially enclose a scene room together with adjacently positioned wall portions of the pair of structures. A small scene room can be enclosed by a scene room wall adjacently positioned to a pair of neighbouring wall portions of the first or second structure.

In an embodiment of the amusement system, the amusement system comprises only a single pair of the first and second structure. In particular, the single pair is positioned in an inner region of the scene room building. The scene room building has a scene room wall which at least partially surrounds the pair of structures to delimit one or more scene rooms. Preferably, each vertical column of each structure has three wall portions forming three segments around the vertical column. The first and second structure are positioned side-by-side, such that a combination of segments can be made to form a common scene room, and/or a common entry station. The scene room wall completely surround the single pair of structures except for one segment to allow a passenger access to form an entry station. Here, an entry station is to be understand as a boarding station serving passengers to access and/or leave. At the entry station, passengers can enter and/or leave a carriage. It is an advantage of the invention, that a single entry station may serve as an access and/or exit to both of the structures.

In an embodiment of the tower ride system according to the invention, the tower ride system comprises a single pair of a first and second tower ride structure. The pair of tower ride structures can be positioned at an inner region of the scene room building. The scene room building has a scene room wall which at least partially surrounds the pair of tower ride structures to delimit one or more scene rooms. Preferably, each tower ride structure is a 3-fold tower ride structure in which each tower ride structure includes three tower ride segments. The first and second tower ride structure are positioned side-by-side, such that tower ride segments of each tower ride structure can be combined to form a common scene room, and/or a common entry station. The scene room wall may completely surround the pair of tower ride structures except for one tower ride segment to allow an access to form an entry station. The entry station may serve as an access and/or exit to one or both of the tower ride structure. Herewith, the single pair of tower ride structures can be used to obtain a high passenger capacity of the tower ride system.

The scene room building surrounding the pair of tower ride structures may have a rectangular outer contour in cross-section. Preferably, seen in a cross-section, the scene room building has an elliptical shape. The scene room wall which delimits a compartment may be formed by an outer wall defining an outer contour of the scene room building.

In an embodiment of the amusement system according to the invention, in the scene room building, a large scene room is positioned opposite an entry station. Two small scene rooms are provided which are seen in a rotational direction each positioned between the entry station and the large scene room. The large scene room and/or the entry station is formed by a combination of segments of both structures. In other words, the large scene room and/or the entry station are positioned in between the vertical columns of the pair of tower ride structures, and the small scene rooms are positioned aside the vertical columns of the pair of tower ride structures. The large scene room is positioned in between the vertical columns and the small scene rooms are positioned outside the pair of vertical columns.

In an alternative embodiment of the scene room building which may be beneficial in adapting the amusement system to a particular attraction, entry stations may be provided at a position aside the vertical columns of the pair of tower ride structures, wherein a first and second large room can be provided in between the vertical columns of the pair of power ride structures.

In an embodiment of the amusement system according to the invention, the amusement system comprises multiple pairs of a first and second structure. The pairs of structures are positioned in a circular arrangement. Each pair forms a common scene room by a combination of segments of neighbouring structures. The common scene room is positioned at an inner region of the scene room building. Multiple common scene rooms at the inner region may be combined to a central large scene room. Herewith, the scene room building of the amusement system includes an extra-large scene room which is beneficial in adapting to a particular attraction.

In a further embodiment, at least one entry station may be provided at an outer circumference of the scene room building. In particular, in an embodiment including an m-amount of pairs of tower ride structures in which the pairs are positioned in a circular array, the scene room building may have an m-amount of entry stations at the outer circumference. The tower ride system may comprise three pairs of a first and second tower ride structure, wherein three entry stations are provided at the outer circumference of the scene room building.

In an embodiment of the amusement system according to the invention, the n-fold tower ride structure is a three-fold structure having three laterally extending wall portions defining three segments. In an alternative embodiment, the n-fold structure may be a four-fold structure having four laterally extending wall portions defining four segments. Advantageously, the scene room building of the amusement system can be tuned to a particular attraction requiring a particular amount and variety of scene rooms.

In an embodiment of the amusement system according to the invention, the scene room wall comprises a screen for displaying a movie to the group of passengers. The amusement system may comprise a media system, in particular a movie watching system, configured to communicate a narrative to passengers in a ride vehicle, wherein a storyline of the narrative includes scenes which are distributed over a sequence of scene rooms. By rotating the structure, the passengers travel along the sequence of scenes.

In an embodiment of the amusement system according to the invention, a scene room inside a scene room building may provide a playing area. The playing area may include interactive elements. Passengers may have user input devices which are configured to enable a passenger to interact with elements presented in the scene room.

Further, the invention relates to a method for entertaining a group of passengers by showing an event a delimited space, in particular formed by a scene room of a scene room building. To carry out the method, an amusement system according to the first aspect of the invention is provided. In operation, a first structure is rotated about its vertical axis in an opposite direction regarding a second neighbouring structure. The first and second structure preferably rotate simultaneously. In the method, a wall portion of the first structure is aligned with a wall portion of the second structure to form a common delimited space. After an alignment of the wall portion, the first and second structure may pause for a while to show the passengers an event in the delimited space.

In an embodiment of the method according to the invention, the passengers may be entertained by providing a passenger view over an open space. The passenger view is bounded by the wall portions of the structures. The delimited space is here formed by a section of the open space which is visual from the carriage.

In an embodiment of the method according to the invention, the first and second structure are rotated with respect to the scene room building to a predetermined angular position to align a wall portion of the structure with a scene room wall of a scene room. A wall portion of the first structure is then aligned with a wall portion of the second structure to form a common delimited space. At least one of the first and second structure may be formed by a tower ride structure. A tower ride can be provided by moving a ride vehicle in a vertical direction.

In an embodiment of the method according to the invention, the method further comprises at least one of the steps of providing a delimited passenger view to an open space, e.g. a predetermined view with visual boundaries formed by the wall portions which view is directed over a particular zoo area or directed to a historic city centre; providing a delimited passenger view to a closed space, e.g. in which the closed space is formed by a scene room of a scene room building; entertaining a passenger by imaging an event; providing a vertical ride by moving a ride vehicle in an vertical direction of the structure; allowing a passenger to play a game by using a game controller; and/or allowing a member of the public to visit a scene room of a scene room building, in particular to take part in a game of the amusement system.

Thus, in a first aspect, the invention provides an amusement system and a method for operating such an amusement system for entertaining a group of passengers by showing at least one event in at least one delimited space, comprising at least one pair of a neighbouring first and second structure, wherein each structure has a centre of rotation defining a vertical axis, and at least one passenger carriage. Each structure comprises at least three wall portions which are laterally extending. A segment is defined in between each neighbouring wall portions. The first and second structure are arranged as a cooperating pair of structures in that in operation the first and second structure are driven in rotation by a control unit in opposite directions with respect to each other.

According to a second aspect of the invention, the invention relates to an amusement system for entertaining a group of passengers by showing an event in a delimited space comprising a structure having a centre of rotation defining a vertical axis; wherein at least a portion of the structure is rotatable about the vertical axis to rotate to an angular position in alignment with the delimited space, which delimited space is in particular a scene room of a scene room building, wherein the structure is provided with at least three wall portions which are laterally extending from the centre of rotation, wherein a segment is defined in between each neighbouring wall portions.

In an embodiment according to the second aspect, the amusement system is a tower ride system which comprises a tower ride structure. At least one tower track is positioned in each segment, a so-called tower ride segment, and at least one ride vehicle is positioned in each tower ride segment connected to the tower track, wherein each ride vehicle includes a carriage for carrying a passenger.

In an embodiment according to the second aspect, the amusement system comprises a scene room building including at least one scene room for showing an event to the passengers, wherein the scene room building comprises a scene room wall which in the angular position of the tower ride structure encloses together with a wall portion at least one tower ride segment of the tower ride structure to delimit a scene room.

In an embodiment according to the second aspect, the tower ride structure is positioned at an inner region of the scene room building. The tower ride structure is rotatable with respect to the scene room building by a control unit. The control unit is programmed to rotate at least a portion of the tower ride structure. The scene room building is arranged stationary. Herewith, advantageously, a simple arrangement is obtained for visiting multiple scene rooms by only rotating the tower ride structure.

In an embodiment according to the second aspect, the tower ride structure is a three fold tower ride structure having three laterally extending wall portions defining three tower ride segments. In particular, the scene room building has seen in a rotational direction three scene rooms. In a vertical direction, the scene room building may have stacked scene rooms. An exemplary embodiment is described hereafter in further detail and shown in FIG. 7.

In an embodiment according to the second aspect, the vertical column has at least one rotatable column portion. Preferably, the vertical column has a lower rotatable column portion for transferring passengers in a rotational direction to and away from a scene room. In an embodiment, the vertical column may have a lower and upper rotatable column portion. An intermediate column portion is arranged stationary. Passengers can be transferred at a lower and upper region of the tower ride structure in a rotational direction to a next scene room. In between each rotation, the passengers can make a single vertical motion. By rotating both the upper and lower portion, a lowering movement, e.g. a free fall, of a tower ride can be made in a predetermined scene room without necessarily elevating the carriage in the same scene room.

Further, the second aspect of the invention relates to a method for entertaining a group of passengers by providing a vertical ride and by showing an event in a delimited space, in particular a scene room, comprising the steps of providing a tower ride system according to the second aspect. In particular, a tower ride structure is positioned at an inner region of a stationary arranged scene room building. In the method, a step is carried out of rotating at least a portion of the tower ride structure, in particular with respect to a scene room building, to an angular position to align a tower ride segment with an delimited space, e.g. with a scene room wall of a scene room. In a step of the method a tower ride is provided by moving a ride vehicle in a vertical direction. In a step of the method an event is shown in the delimited space, in particular in the scene room.

In an embodiment of the method according to the second aspect, the method further comprises at least one of the steps of: providing a delimited passenger view to an open space, e.g. a predetermined view with visual boundaries formed by the wall portions which view is directed over a particular zoo area or directed to a historic city centre; providing a delimited passenger view to a closed space, e.g. in which the closed space is formed by a scene room of a scene room building; entertaining a passenger by imaging an event; providing a vertical ride by moving a ride vehicle in an vertical direction of the structure; allowing a passenger to play a game by using a game controller; and/or allowing a member of the public to visit a scene room of a scene room building, in particular to take part in a game of the amusement system.

Further embodiments according to the second aspect may include features described above in the embodiments including a pair of neighbouring structures according to the first aspect of the invention and described in the detailed description with reference to the drawings.

Further, the invention relates to an amusement park comprising an amusement system as described above.

The aspects of the invention will be explained in more detail with reference to the appended drawings. The drawings show a practical embodiment according to the invention, which may not be interpreted as limiting the scope of the invention. Specific features may also be considered apart from the shown embodiment and may be taken into account in a broader context as a delimiting feature, not only for the shown embodiment but as a common feature for all embodiments falling within the scope of the appended claims, in which:

Figure 1:
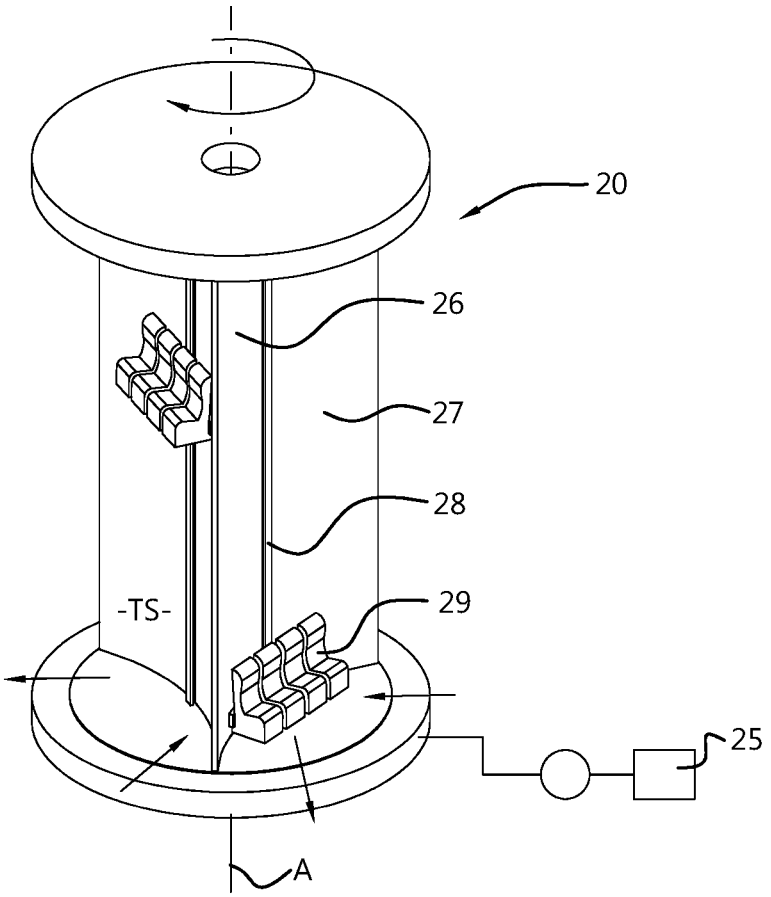
FIG. 1 shows a three-fold tower ride structure including a rotatable vertical column with three laterally extending wall portions forming three tower ride segment and each including a tower track with a ride vehicle.

Identical reference signs are used in the drawings to indicate identical or functionally similar components. To facilitate comprehension of the description and of the claims the words vertical, horizontal, longitudinal, cross-sectional with reference to the gravity are used in a non-limiting way.

The invention relates to an amusement system, here a tower ride system 1, for entertaining a group of passengers. The tower ride system 1 is designed to deal with a high volume of passengers. To obtain a high passenger capacity, the tower ride system 1 provides multiple tower rides at the same time.

FIG. 1 shows a tower ride structure 20 of a tower ride system 1. In the tower ride system 1, passengers are carried by a ride vehicle 29 and entertained by a tower ride within a special scenery. During the tower ride, the passengers move in a vertical direction along a tower track 28. As in a classic tower ride, the passengers can be elevated to a top region, whereafter they experience a free-fall when the passengers fall down along the tower track. In another embodiment of a tower ride, the passengers may e.g. play a game at different high-levels.

As shown in FIG. 1, the tower ride structure 20 has a vertical column 26. The vertical column 26 defines an axial axis A-A which is a vertical axis. Along its length, the vertical column 26 is provided with a plurality of tower tracks 28 for moving a ride vehicle up and down. The ride vehicle 29 is movable up and down along the tower track 28. The tower tracks 28 are equally spaced around the vertical axis A-A. Here, the tower tracks 28 are directly mounted to the vertical column 26. A ride vehicle 29 is connected to each tower track 28 to provide a tower ride to a group of passengers. Each ride vehicle 29 has a carriage 290 for carrying passengers. Here, the carriage 290 is provided with four seats 291.

The vertical column 26 of the tower ride structure 20 is provided with a plurality of wall portions 27. Each wall portion 27 extends from the vertical column 26 in a lateral direction. Here, each wall portion 27 is radially extending from the vertical axis. Neighbouring wall portions 271, 272 define a tower ride segment TS in between them. Here, the tower ride structure 20 has three wall portions 271, 272, 273 defining three tower ride segments TS1,TS2,TS3.

Figure 2:
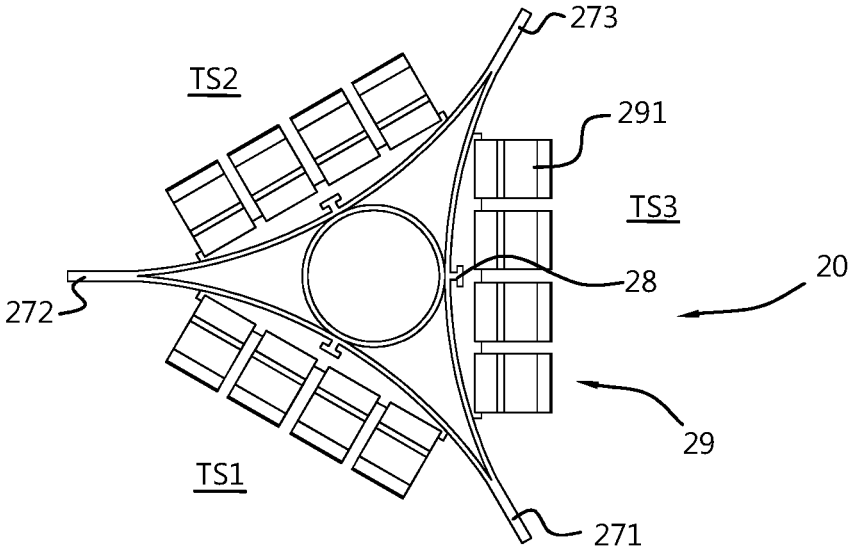
FIG. 2 shows a cross-sectional top view of the tower ride structure of FIG. 1.

FIG. 2 shows a top view of the tower ride structure 20 as shown in FIG. 1 in a cross-section. The tower ride structure 20 has a rotational symmetry. Here, the tower ride structure is a three-fold tower ride structure 20 having three equally spaced wall portions 27 about the vertical axis A-A. Each tower ride segment TS is provided with at least one a tower track 28 and at least one ride vehicle 29.

Here, each tower ride segment TS is provided with a single tower track 28 and a single ride vehicle 29. Each tower track 28 is mounted to the vertical column 26. In another embodiment multiple tower tracks 28 and ride vehicles 29 may be arranged side-by-side in a tower ride segment TS. A tower track 28 may be mounted to a wall portion 27 instead of a direct mount to the vertical column 26. Herewith, passengers in side-by-side arranged ride vehicles 29 in the same tower ride segment TS can enjoy the same event presented in a scene room SR at the same time.

At least a portion of the tower ride structure 20 according to the invention is rotatable about the vertical axis A-A. At least a portion of the vertical column 26 is rotatable about the vertical axis A-A. Preferably, a lower portion of the vertical column 26 is rotatable. The rotatable portion of the vertical column 26 is rotatable in between tower ride segments TS.

The vertical column 26 may have a stationary column portion with stationary wall portions and a rotational column portion in which laterally extending wall portions are rotational together with this rotational column portion. Only the rotational column portion of the vertical column 26 including a tower track portion may be rotatable, while a remaining portion of the vertical column 26 with a remaining tower track portion may be arranged stationary. During a rotation, the rotatable tower track portion switches between tower ride segments TS and connects to a fixed arranged tower track portion in a respective tower ride segment TS.

Here in FIGS. 1 and 2, a simple embodiment is shown, in which the whole vertical column 26 is rotatable, such that in operation a whole length of a tower track 28 rotates about the vertical axis A-A.

The experience of the tower ride is enriched by a scenery. In an embodiment, as shown in FIG. 1, the amusement system may be an observation system providing an open view to an environment to a passenger in which a passenger outlook is only limited by wall portions 27 of the structure to have a directed sight over a predetermined space, e.g. to watch a historic city centre or a sectional area of an amusement park.

Figure 3:
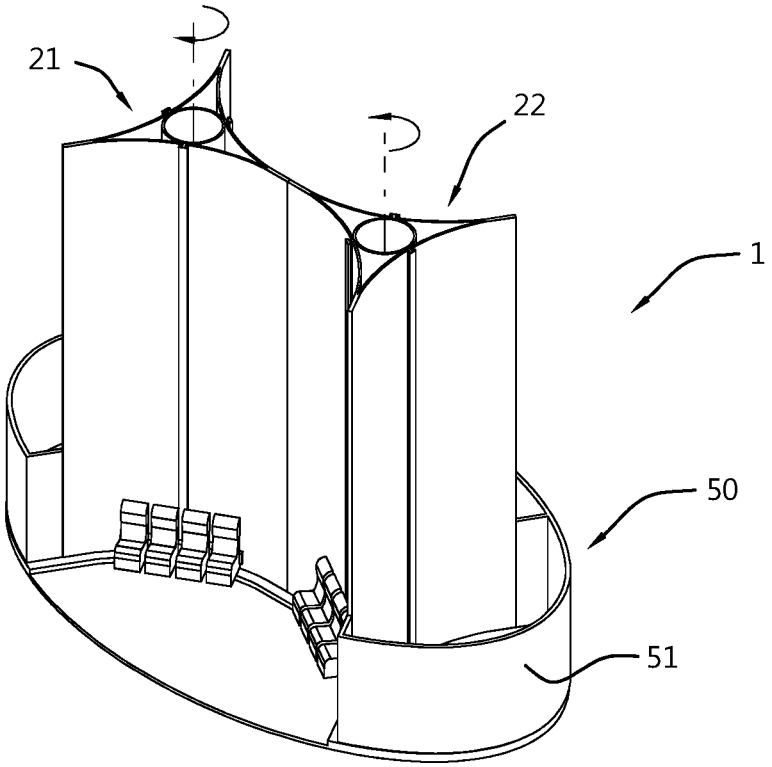
FIG. 3 shows an embodiment of a tower ride system comprising a scene room building including a pair of tower ride structures as shown in FIG. 1.

As shown in FIG. 3, the scenery around the tower ride is provided in a scene room SR of a scene room building 50. The scene room SR is delimited by a scene room wall 51. An event is presented in the scene room SR which event is visual from the ride vehicle 29. The event may for example be provided by a puppet play or a movie on a screen. In the tower ride system 1, passengers access the scene room building 50 at an entry station ES and are subsequently distributed over two or more tower ride structures 20.

Figure 4:
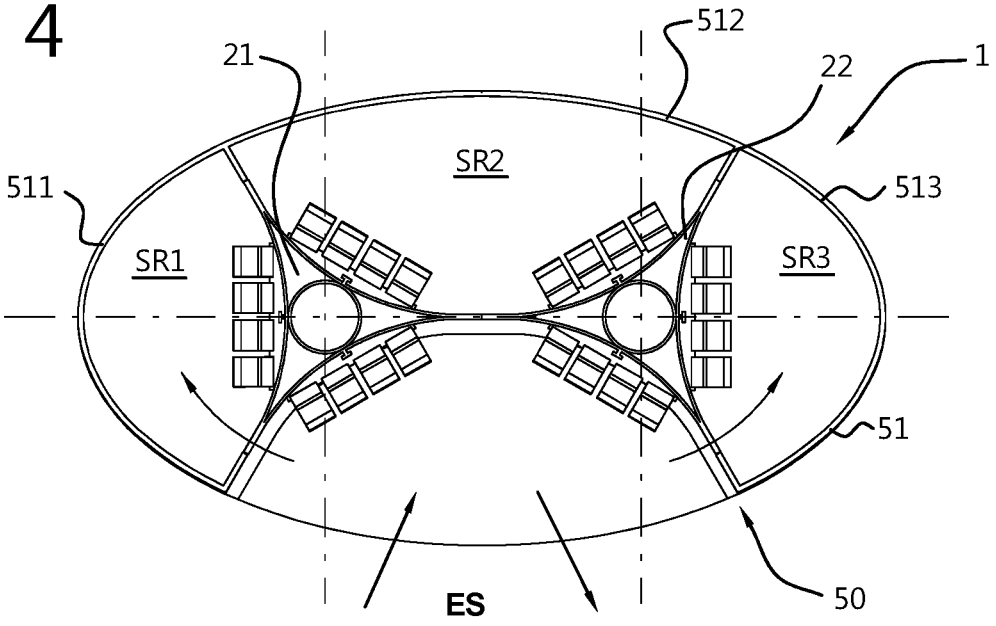
FIG. 4 shows a cross-sectional top view of the scene room building of FIG. 3.

A said above, in the tower ride system 1 according to the invention, passengers experience a tower ride in combination with an event which event may be presented to them in a scene room SR. FIG. 3 shows a scene room building 50 including several scene rooms SR. FIG. 4 shows a top view of the scene room building of FIG. 3 in cross-section.

A first and second tower ride structure 21, 22 are arranged inside the scene room building 50. The tower ride structures 21, 22 are positioned at a centre region of the scene room building 50. The scene room building has an outer wall 51. The outer wall at least partially surrounds the first and second tower ride structures 21, 22. At one side of the scene room building 50, the outer wall 51 has a wall opening which allows passengers to enter and exit the scene room building 50. At the entry station ES, passengers are getting on board a ride vehicle. A rotation of the tower ride structures 21, 22 subsequently transfers the passengers to a scene room SR of the scene room building 50.

The outer wall 51 delimits at least one scene room SR. Here, the outer wall delimits three scene rooms SR1, SR2, SR3. The scene room building 50 contains a large scene room SR2 which is positioned opposite the entry station ES for loading and unloading passengers. Further, the scene room building 50 contains two smaller scene rooms SR1, SR3 which are respectively positioned at a left and right side of the entry station ES. The two small scene rooms SR1, SR3 are positioned opposite each other.

The first and second tower ride structures 21, 22 of the tower ride system are both a three-fold tower ride structure 20 as shown in FIGS. 1 and 2. Each tower ride structure 21, 22 has three tower ride segments. Each tower ride structure 21, 22 is arranged to rotate between three angular positions. In a first angular position, a first tower ride segment TS1 is positioned at the entry station ES in which a ride vehicle 29 can be loaded with passengers. Here, the entry station ES also serves as an exit station. In a second angular position, the first tower ride segment TS1 is rotated to a scene room SR1, wherein passengers can enjoy a tower ride in a particular scenery. In the third angular position, the first tower ride segment TS1 is rotated to a next scene room SR3, wherein passengers can be entertained by another tower ride in another scenery.

The first and second tower ride structure 21, 22 are operated as pair of cooperating tower ride structures. The first and second tower ride structures 21, 22 are operated by a control unit 25, such that in operation the first and second tower ride structure 21, 22 are driven in rotation in opposite directions with respect to each other. As indicated by arrows in FIG. 3, when the first tower ride structure 21 rotates in a clockwise direction, the neighbouring tower ride structure 22 rotates in a counter-clockwise direction. Hence, in operation the first and second tower ride structure 21, 22 cooperate with each other in a way that passengers who have at the same time entered at the entry station in different ride vehicles of neighbouring tower ride structures, will arrive at the same time at the large scene room SR3. The third angular position may for example correspond with a rotation of the first tower ride segment TS1 to the large scene room SR2. The passengers who entered together at the entry station ES at neighbouring tower ride structures will first rotate to a small scene room SR1/SR3, whereafter the passengers meet again in the large scene room SR2. A storyline can be started in the small scene room and ended at the large scene room. After the experience in the large scene room SR2, the passengers rotate back to the entry station ES, where they can leave the ride vehicles, and a next group of passengers can enter the ride vehicle 29.

Figure 5:
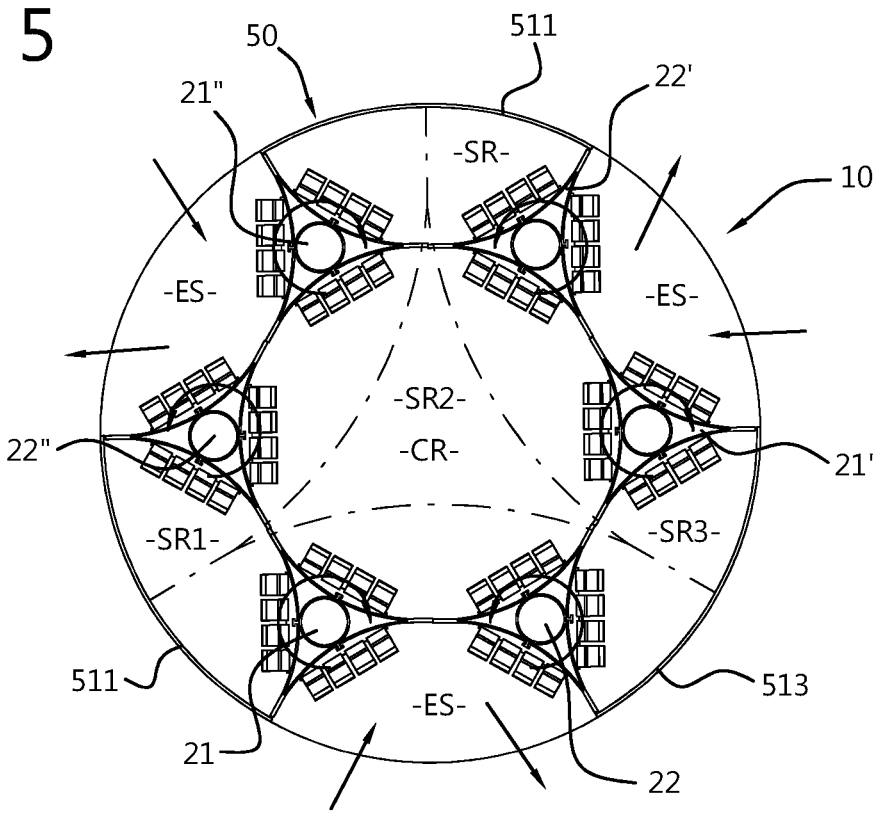
FIG. 5 shows an embodiment of a tower ride system comprising a scene room building including a circular array of pairs of tower ride structures.
Figure 6:
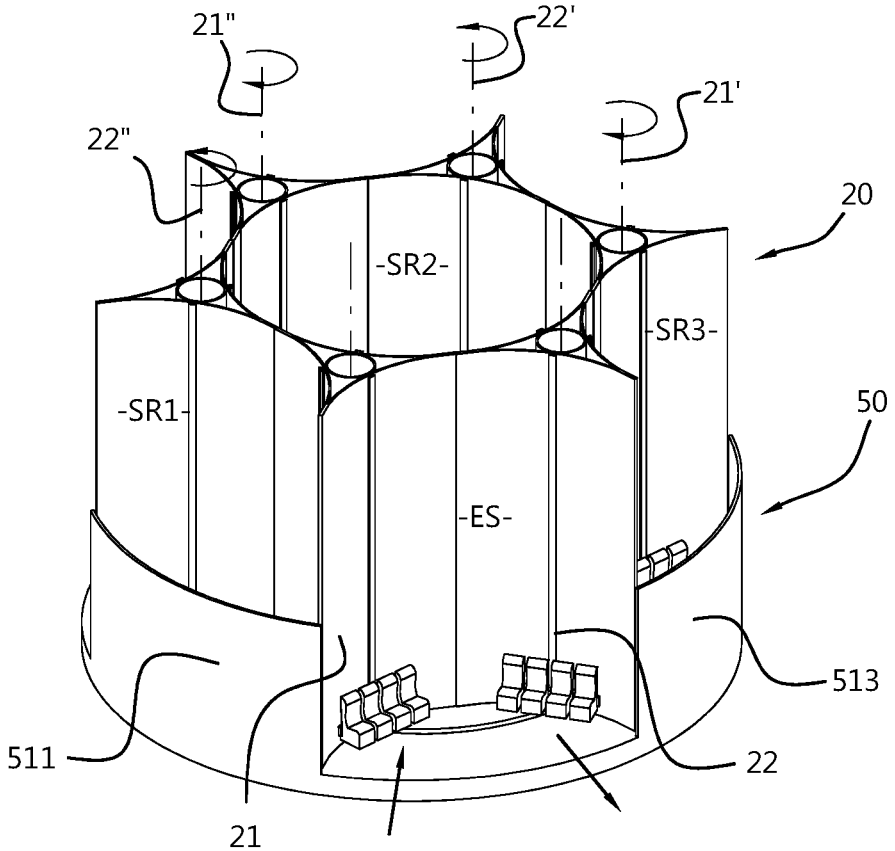
FIG. 6 shows a perspective view of the embodiment of the tower ride system of FIG. 5.

FIGS. 5 and 6 show a further elaborated embodiment of a tower ride system 10. FIG. 6 shows the tower ride system 10 of FIG. 5 in a perspective view. The tower ride system 10 contains three pairs of neighbouring tower ride structures 21, 22; 21', 22'; 21", 22". Each tower ride structure of a pair is controlled to rotate in a counter direction. Herewith, a first tower ride segment TS1 of one of the tower ride structures 21 is in operation related to a first tower ride segment of the neighbouring tower ride structure 22 in that these tower ride segments meet each other twice in a full rotation of 360°. A first time at the entry station ES, and a second time at the large scene room TS2.

Here, in FIG. 5, in the scene room building 50, the pairs of neighbouring tower ride structures 21, 22; 21', 22'; 21", 22" are positioned in a circular array. At a centre region CR of the scene room building 50, the large scene rooms SR2 indicated by a dashed line (corresponding with FIG. 3) are combined to a central large room in which all the passengers who entered at the same time in different tower ride structures come together to enjoy a particular event. As an outer circumference, the scene room building has several entry stations ES for loading/unloading passengers. Here, scene room building 50 has three entry stations ES. A scene room SR1, SR3 is positioned aside each entry station ES. This scene room is visited by the passengers of neighbouring tower ride structures when the pair of tower ride structures 21, 22 rotate counter directional.

Figure 7:
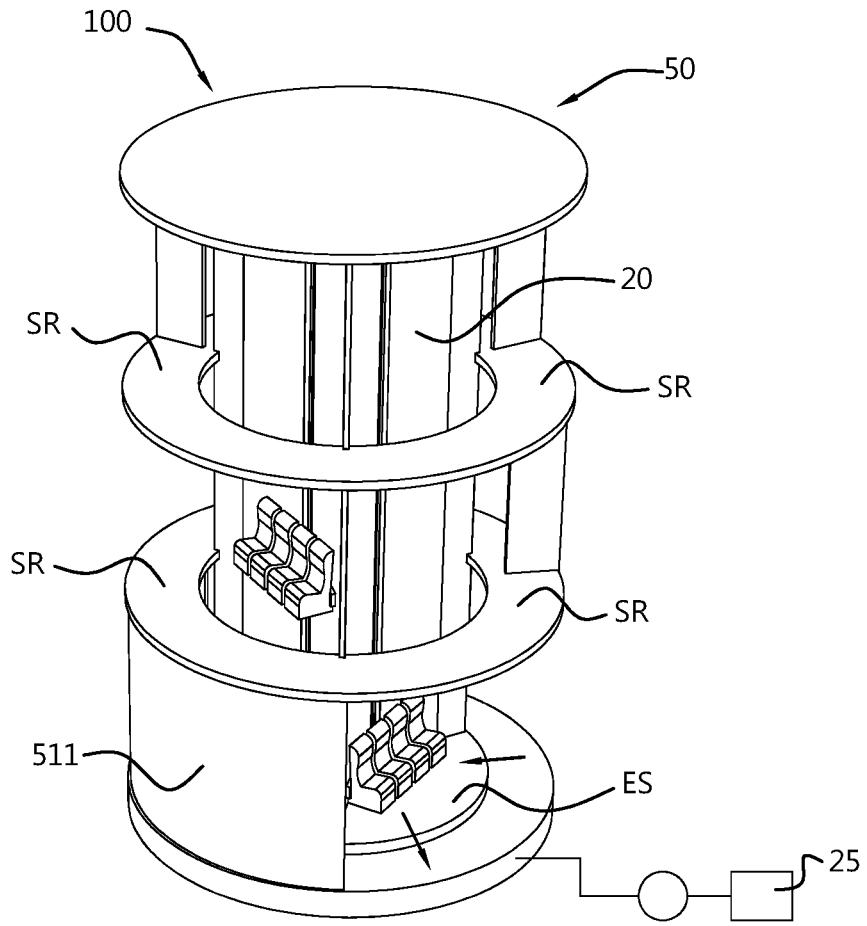
FIG. 7 shows an embodiment of a tower ride system including a single tower ride structure rotatable positioned inside a stationary scene room building.

FIG. 7 shows another embodiment of a tower ride system 100 for entertaining the group of passengers by providing a tower ride and by showing an event in a scene room. The tower ride system 100 has a tower ride structure 20 which is centrally positioned in a scene room building 50. The tower ride structure 20 is configured as shown in FIG. 1. The tower ride structure 20 has an n-fold rotational symmetry. Here, a three-fold rotational symmetry. Radially extending wall portions 27 define a tower ride segment ST in which each tower ride segment TS comprises at least one tower track 28 to provide a tower ride to some passengers.

The scene room building 50 surrounds the tower ride structure 20. The scene room building 50 contains a plurality of scene rooms SR. In a rotational direction, the scene room building has an (n−1)-fold amount of scene rooms for showing an event to the passenger. Here, in the rotational direction, the scene room building 50 has two such scene rooms SR and one entry station ES. In a vertical direction, the scene room building 50 comprises a stack of scene rooms SR. By moving a ride vehicle 29 in the vertical direction, the passengers are transferred to an upper scene room SR.

FIGS. 8-11 show another embodiment of the amusement system 10 according to the invention. As in the embodiment of FIG. 6, three pairs of structures 21,22; 21',22'; 21",22" are positioned in a circular arrangement. The three pairs of structures include each a first and second structure 21, 22 which are controlled to rotate in opposite directions with respect to each other. At a central position, a stationary auxiliary structure is provided which is part of a scene room building. The stationary structure is similar in shape to the rotatable surrounding pairs of first and second structures in that the stationary structure also has three sidewalls 511, 512, 513.

Figure 8:
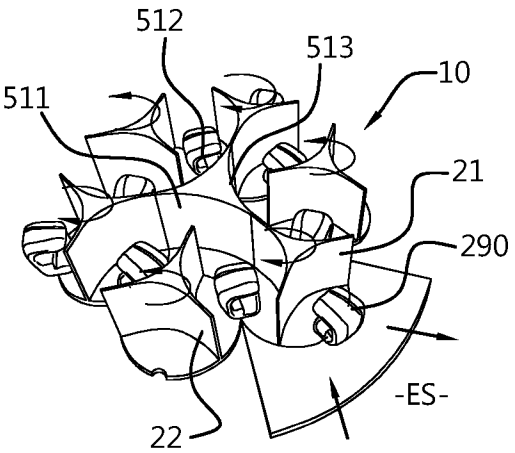

FIG. 8 shows a starting angular position of the rotatable structures 21, 22. In the starting position, a carriage 290 is positioned at an outer circumference of the amusement system and can be loaded with passengers. From the starting position, the carriage 290 will travel along a travel path through the amusement system 10 formed by the circular arrangement of the pair of structures. The travel path is meandering through the amusement system. The travel is preferably a stepwise motion which motion is meandering through the scene rooms SR1, SR2, SR3 formed by the arrangement of rotatable structures. The carriage 290 may be mounted to a rail forming the travel path for guiding the carriage through the scene rooms.

Figure 9:
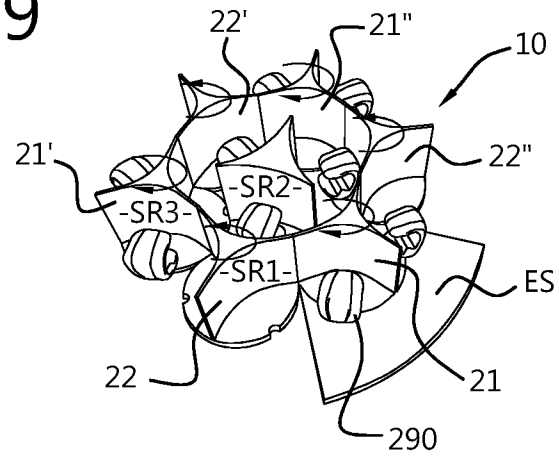
FIG. 8-11 show an embodiment of the amusement system including a circular arrangement of rotating pairs of structures and carriages passing these structures.
Figure 10:
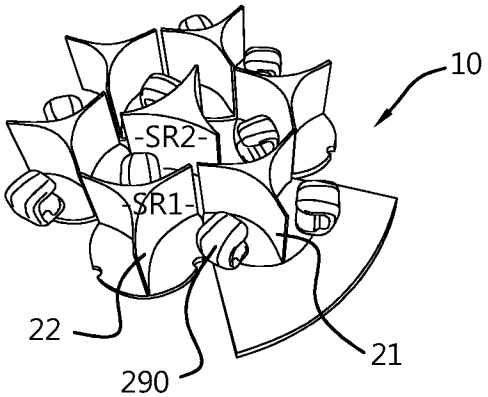

As shown in FIGS. 9 and 10, the carriage 290 travels simultaneously with a rotation of the first structure 21 into a direction of the second structure 22. Here, the carriage 290 arrives at a large scene room SR1 formed by a segment of the first structure 21 in combination with a segment of the second structure 22. The carriage 290 is preferably rotatable about a vertical axis to direct a passenger view across the whole scene room SR1.

Figure 11:
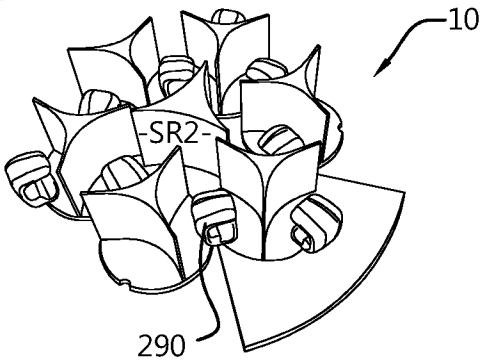

As shown in FIG. 11, a travel of the carriage 290 continues. The carriage 290 will travel to a next scene room SR2. In entering the next scene room SR2, the visited scene room SR1 appears to open due to wall portions of the first and second structure 21, 22 moving away from each other to allow the carriage 290 to pass. When the first and second structure 21, 22 have rotated sufficient far, the carriage 290 can pass through the opening to the next scene room SR2 which configuration is depicted in FIG. 8. From this point, the carriage may travel together with the movement of the second structure 22' and enjoy an event presented in the delimited space formed by the first and second structure. Subsequently the carriage travels to a scene room formed by the sidewall 512 of the stationary structure. Thereafter, the carriage travels further to a scene room formed by the first structure 21' of the next pair of structures and the second structure 22.

Similar to the shown embodiment in FIGS. 5 and 6, the stationary structure 50 as shown in the central region of FIG. 9 may be omitted. Without this stationary structure 50, the carriage 290 will be received in an extra-large common scene room which is formed by segments of all pairs of structures. Passengers situated in the extra-large common scene room may for example play a game or watch an event in the inner area of the scene room building. A carriage 290 can travel along all the pairs of neighbouring structures. Passengers can travel all around or be loaded and unloaded at several positions at the outer circumference as similarly shown by the entry stations depicted in FIGS. 5 and 6.

Numerous variants are possible in addition to the embodiment shown in the figures. In a variant of the illustrated embodiment of FIG. 1 in which the vertical column rotates as a whole, only a column portion may rotate with respect to a remaining stationary column portion to transfer passengers to a next angular position. In a variant of the embodiment shown in FIG. 3, an entry station may be provided at headings of the scene room building. In a variant of the embodiment of FIG. 8 at least one of the neighbouring pairs may include a tower ride system as shown in FIG. 1.

Although the present invention has been described in detail, it will be apparent to those skilled in the art that various changes and modifications can be made without departing from the scope of the invention as hereinafter claimed. It is intended that all such changes and modifications be encompassed within the scope of the present disclosure and claims.

REFERENCE SIGNS LIST

| | |
|---|---|
| 1, 10 amusement system; tower ride system | |
| 20 structure; tower ride structure | 28 tower track |
| 21 first structure; tower ride structure | 29 ride vehicle |
| 22 second structure; tower ride structure | 290 carriage |
| 26 column | 291 seat |
| A-A axial axis; vertical axis | 25 control unit |
| 27 wall portion | 50 scene room building |
| 271 first wall portion | 51 outer wall |
| 272 second wall portion | 511, 512, 513 scene room wall |
| 273 third wall portion | |
| | SR scene room |
| TS tower ride segment | SR1, SR3 small scene room |
| TS1first tower ride segment | SR2 large scene room |
| TS2 second tower ride segment | ES entry/exit station |
| TS3 third tower ride segment | CR centre region |

The invention claimed is:

1. An amusement system for entertaining a group of passengers by showing at least one event in at least one delimited space, comprising:

at least one pair of a neighbouring first and second structures, wherein each structure has a centre of rotation defining a vertical axis A-A, wherein at least a portion of the structure is rotatable about the vertical axis A-A to rotate to an angular position in alignment with the delimited space; and at least one carriage for carrying at least one passenger, wherein each structure comprises at least three wall portions which are laterally extending from the vertical axis A-A, wherein a segment is defined in between each neighbouring wall portion; and wherein the first and second structures are arranged as a cooperating pair of structures in that in operation the first and second structures are driven in rotation by a control unit in opposite directions with respect to each other, such that passengers of the first structure can meet passengers of the neighbouring second structure in a common delimited space.

2. The amusement system according to claim 1, wherein the amusement system is an observation system for providing a passenger view in a predetermined direction, the passenger view being delimited by neighbouring wall portions aside the carriage.

3. The amusement system according to claim 1, wherein each structure comprises a vertical column defining the vertical axis A-A.

4. The amusement system according to claim 3, wherein the vertical column has at least one rotatable column portion.

5. The amusement system according to claim 1, wherein the at least a portion of the structure is rotatable in a stepwise manner.

6. The amusement system according to claim 1, further comprising a vertical motion system for entertaining a group of passengers by providing a vertical ride and by showing an event in the delimited space, wherein the at least one pair of a neighbouring first and second structures is a pair of a first and second ride structures, in which each ride structure is provided with at least one tower track and at least one ride vehicle which includes the carriage, and wherein the ride vehicle is connected to the tower track to provide a vertical ride to the group of passengers.

7. The amusement system according to claim 1, further comprising a scene room building including at least one scene room for showing an event to the passengers.

8. The amusement system according to claim 7, wherein the scene room building comprises a stack of scene rooms.

9. The amusement system according to claim 7, wherein the scene room building is formed by a shopping mall.

10. The amusement system according to claim 7, wherein the amusement system comprises only a single pair of the first and second structures, the single pair of the first and second structures being positioned at an inner region of the scene room building.

11. The amusement system according to claim 7, wherein the scene room building comprises a scene room wall, the scene room wall at least partly enclosing, in the angular position of the pair of the first and second structures, together with wall portions, at least one segment of the pair of the first and second structures to delimit a scene room.

12. The amusement system according to claim 11, wherein the scene room wall at least partially surrounds both of the neighbouring first and second structures, wherein the scene room wall encloses both a segment of the first structure and a segment of the second structure to form a common scene room.

13. The amusement system according to claim 7, wherein the scene room building has a large scene room positioned opposite an entry station for accessing and/or leaving a carriage, the entry station being positioned in between the centres of rotation of a pair of neighbouring structures.

14. The amusement system according to claim 7, wherein the scene room building comprises at a mid-region two large scene rooms opposite each other and two entry stations at a position aside the centres of rotation.

15. The amusement system according to claim 1, wherein the amusement system comprises multiple pairs of the neighboring first and second structures, wherein said multiple pairs are positioned in a circular arrangement, in which each multiple pair forms a common scene room by a combination of a segment of the first structure and a segment of the second structure.

16. The amusement system according to claim 15, wherein the amusement system comprises only three pairs of the neighbouring first and second structures in the circular arrangement.

17. The amusement system according to claim 15, wherein the amusement system includes multiple entry stations at an outer circumference.

18. An amusement park comprising the amusement system according to claim 1.

19. A method for entertaining a group of passengers by showing an event in a delimited space comprising the steps of:

providing the amusement system according to claim 1 comprising the at least a pair of a first and second structures positioned side by side to obtain the delimited space at a predetermined angular position of the first and second structures;

rotating each of the first and second structures to the angular position, wherein the first structure rotates in an opposite direction with respect to the second structure;

aligning in the angular position a wall portion of the first structure with a wall portion of the second structure to form a common delimited space; and showing the event in the delimited space.

20. The method according to claim 19, further comprising at least one of the steps of:

providing a delimited passenger view to an open space;

providing a delimited passenger view to a closed space;

entertaining a passenger by imaging an event;

providing a vertical ride by moving a ride vehicle in a vertical direction of the structure;

allowing a passenger to play a game by using a game controller; and/or allowing a member of the public to visit a scene room of a scene room building, to take part in a game of the amusement system.

* * * * *